United States Patent [19]

Ishida

[11] Patent Number: 4,483,432

[45] Date of Patent: Nov. 20, 1984

[54] STEPS IN AN ESCALATOR

[75] Inventor: Matsuhiko Ishida, Inazawa, Japan

[73] Assignee: Mitsubishi Denki Kabushiki Kaisha, Tokyo, Japan

[21] Appl. No.: 333,681

[22] Filed: Dec. 23, 1981

[30] Foreign Application Priority Data

Feb. 13, 1981 [JP] Japan ..... 56-19708

[51] Int. Cl.[3] ..... B65B 9/12

[52] U.S. Cl. ..... 198/333; 198/853

[58] Field of Search ..... 198/326, 332, 333, 853, 198/324; 104/25

[56] References Cited

U.S. PATENT DOCUMENTS 2,723,020 11/1955 Margles et al. ..... 198/333
2,981,397 4/1961 Hansen ..... 198/325
3,735,851 5/1973 Patin ..... 198/334
4,295,556 10/1981 Saito et al. ..... 198/333

*Primary Examiner*—Joseph E. Valenza
*Attorney, Agent, or Firm*—Wenderoth, Lind & Ponack

[57] ABSTRACT

An escalator step having a tread and a convex riser, the riser being provided on its convex surface with a number of alternating first and second grooves which are shallow and deep respectively. The tread is provided on the surface with a number of first and second alternating cleats corresponding to the first and second grooves of the riser, the ends of the first and second cleats projecting from the side opposite to the riser a short and a long distance, respectively, corresponding to the depths of the first and second grooves of the riser. The end of the tread at the side adjacent the riser is constituted by recesses conforming to the first and second grooves of the riser.

3 Claims, 20 Drawing Figures

STEPS IN AN ESCALATOR

BACKGROUND OF THE INVENTION AND PRIOR ART

The present invention relates to an escalator and more particularly to an improvement in the steps of an escalator.

In FIGS. 1 to 6 of the attached drawings there is shown an example of typical conventional escalator steps. In FIG. 1, the reference numeral 1 indicates an escalator, having steps 2 to transfer a passenger 3 thereon. A number of steps 2 are connected together by a linkage (not shown) at a definite pitch p (usually about 400 mm) in an endless fashion such that the treads 21 of adjoining steps 2 lie together so as to be aligned with each other in a plane at locations c and c' constituting upper and lower landing portions 4 and 4', and so that steps 2 move in a stair-like fashion between the landing portions. Steps 2 are shown in detail in FIGS. 2 to 4 and 6. The tread 21 for carrying a passenger usually has a width W of 600 to 1,000 mm, a number of cleats 211 having a thickness T1 (usually about 3 mm), and grooves 212 alternately disposed thereon at a definite pitch P1 (usually about 9 mm). The forward ends 213 of the cleats 211 project beyond grooves 212 a definite distance L1 (usually about 6 mm). A convex riser 22 is provided at the rear end of tread 21 so as to form substantially an L-shaped configuration therewith, and has a number of cleats 221 each having a definite thickness T1 and grooves 222 alternately disposed on the convex surface at a definite pitch P1 the same as that of cleats 211 of tread 21. The forward ends 213 of cleats 211 on tread 21 of the step directly behind any given step are adapted to be engaged in grooves 222 in riser 22. Brackets 23 integrally connect tread 21 with riser 22, and rollers 24 are mounted on axles 25 on brackets 23, the rollers 24 being adapted to roll on guide rails (not shown) by connecting axles 25 to linkages not shown.

When steps 2 are connected together in an endless fashion and moved in the direction shown by the arrow A in FIG. 1, i.e. when escalator 1 is operated upwards, at the time steps 2 pass through the region between points B and C shown in FIG. 1, step 2 moves, as shown in FIG. 5, stepwise relative to preceeding step 2' in the direction represented by the arrow D from a position E through a position F to a position G where the tread thereof is level with the tread on the preceding step 2'. In this case, should a passenger 3 carried on step 2 strongly thrust the toe 32 of his footwear 31 against cleats 211 of riser 22 of preceeding step 21, toe 32 is forcibly bent downwards due to friction with the riser 22, particularly when the footwear 31 is made of rubber which has a relatively large coefficient of friction, and when step 2 reaches position G, i.e. a level state, since there is usually a gap 26 of width H of 3 to 5 mm left extending across the whole width of steps 2 and 2' between forward ends 213 of cleats 211 of tread 21 of step 2 and the rear ends of cleats 211 of tread 21 of preceeding step 2', there arise disadvantages such that toe 32 of footwear 31 can become caught in the gap 26 formed between adjacent steps 2 and 2', i.e. between forward ends 213 of cleats 211 of tread 21 of step 2 and the rear ends of cleats 211 of tread 21 of preceeding step 2', or long bar-like foreign objects are apt to fall through gap 26, and if the foreign objects are made of hard metal or plastic they may cause damage to the mechanical parts of escalator 1 due to being thrust into the upper and lower landing portions 4.

FIGS. 7 to 11 show another example of conventional escalator steps wherein the forward ends 213 of alternate cleats 211 of tread 21 project a distance L1 while the rear ends of these same cleats 211 which have projecting forward ends 213 are shortened such that the rear ends 213' of these cleats 211 are aligned with the bottom faces of grooves 222 in riser 22 each having a depth of L1, and the rear ends 214' of cleats 214 which do not have projecting forward ends project by a distance L1 together with portions of the adjoining grooves so as to have a width T2, whereby riser 22 has cleats 221 each having a height L1 and a width T2 aligned with rear ends 214' of cleats 214 of the tread 21.

Thus, in this example pitch P2 of cleats 221 and grooves 222 in riser 22 is double the pitch P1 in the first example, width T2 of cleat 221 being 1 to 4 times the width T1 of the cleat in the first example. (In the example shown this is about 3.5 times.)

In the case where an escalator provided with steps having such a construction is operated to move upwards, as shown in FIGS. 10 and 11, irrespective of whether the treads of adjoining steps 2 and 2' are in a stair-like state as represented at positions E and F, or they are aligned in a horizontal state as shown at position G, the forward ends 213 of cleats 211 of tread 21 of step 2 are engaged in grooves 222 of riser 22 of the preceeding step 2' of indented portions of tread 21 thereof at the rear end thereof which are in communication with grooves 222. Therefore, even when the treads of steps 2 and 2' are aligned in a horizontal state as shown at G in FIG. 10, the forward ends 213 of cleats 211 of tread 21 of step 2, as shown in FIG. 11, engage rear ends 213' of cleats 211 of tread 21 of preceeding step 2' (including also portions of adjoining grooves 222) to a depth J so that there is no linear gap 26 as in the first example, preventing the occurrance of footwear or long foreign objects being caught between the confronting ends of adjacent steps 2 and 2' as in the first example. However, on the other hand, when steps 2 are in a stair-like state in the region between points B and B' shown in FIG. 1, the length S of gap 27 formed between adjacent projecting ends 213 of cleats 211 of tread 21, gap 27 having a clearance H of 3 to 5 mm between the confronting forward end 214 of cleat 211 of tread 21 of step 2 and rear end 214' of cleat 211 of tread 21 of the preceeding step, becomes larger than the corresponding length in the first example so that coarse dirt is apt to fall through gap 27 formed between two adjacent steps 2 and 2' and be caught in the interior of the escalator, possibly causing its breakdown.

SUMMARY OF THE INVENTION

It is an object of the present invention to provide escalator steps which make it difficult for the footwear of passengers to be caught in, or foreign objects such as dirt, etc. to fall down through the gap formed between adjoining steps in the escalator over the whole range from the lower to the upper landing portions.

It is another object of the present invention to provide escalator steps which can provide passengers with greater safety.

In accordance with the present invention an escalator step is provided which comprises a riser provided on its convex surface with a number of first shallow grooves and a number of second deep grooves alternating with the first grooves, and a tread having on the surface thereof a number of first cleats the ends of which project a short distance at the side opposite from the riser, the distance corresponding to the shallow depth of the first grooves, and a number of second cleats, alternating with the first cleats, the ends of which project a distance on the side opposite from the riser corresponding to the depth of the second grooves, and the end of the tread at the position corresponding to the riser is shaped so as to conform to the depths of the first and second grooves in the riser.

BRIEF DESCRIPTION OF THE DRAWINGS

Other objects and advantages of the present invention will become apparent from the following description taken in connection with the accompanying drawings wherein are set forth by way of illustration and example certain embodiments of the present invention, and in which.

DESCRIPTION OF THE PREFERRED EMBODIMENTS

Figure 15:
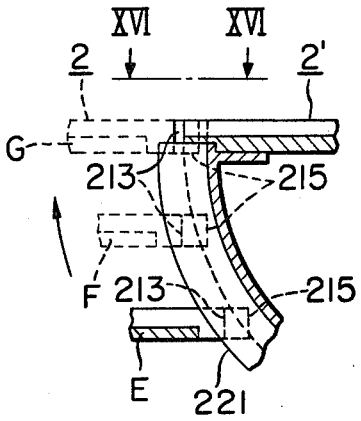
FIG. 15 is a partial side elevational view, on an enlarged scale, showing the relationship between the two adjoining steps when they move through the region between points B and C in FIG. 1.
Figure 16:
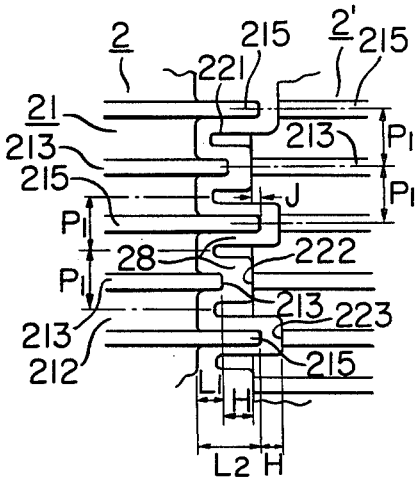
FIG. 16 is a partial plan view of the steps shown in FIG. 15 as viewed in the direction shown by the arrows XVI in FIG. 15.

Referring now to FIGS. 12 to 16 of the drawings wherein is shown an embodiment of the present invention, the step 2 has a riser 22 which is shaped as a convex surface provided with a number of shallow first grooves 222 and a number of deep second grooves 223. Grooves 222 and 223 are disposed alternately at a pitch P1, and a tread 21 which is provided on its upper surface with a number of first cleats 213 arranged so as to correspond to the second grooves 223 of riser 22 and to protrude by a distance L2, equal to twice the distance of L1, at the side opposite from riser 22, i.e. the front side. First and second cleats 213 and 214 are alternately arranged at a pitch P1 with cleats 213 and 215 projecting into grooves 222 and 223 of riser 22 of the next preceeding step 2', respectively. Tread 21 has at the end adjacent riser 22 a profile with recesses corresponding to the depths of first and second grooves 222 and 223 of the riser 22. The bottoms of the respective grooves 222 and 223 are spaced from the ends of the respective cleats 213 and 215 by a distance H, which is less than the difference between L2 and L1. Thus, it will be appreciated that, as shown in FIGS. 15 and 16, first and second cleats 213 and 215 of tread 21 of step 2 are formed such that first cleats 213 engage in first grooves 222 of riser 22 of preceeding step 2', and similarly second cleats 215 engage second grooves 223 of riser 22 of step 2'. Because step 2 has such a construction, over the whole range from lower landing portion 4 to upper loading portion 4 shown in FIG. 1 the forward ends of first cleats 213 of tread 21 of step 2, each projecting only a small distance always engage in the shallow first grooves 222 of riser 22 of the preceeding step, and those of second cleats 215, each projecting a larger distance, always engage in the deep second grooves 223 thereof, so that cleats 213 and 215 of tread 21 of step 2 and grooves 222 and 223 of the riser of preceeding step 2' always engage each other.

Figure 1:
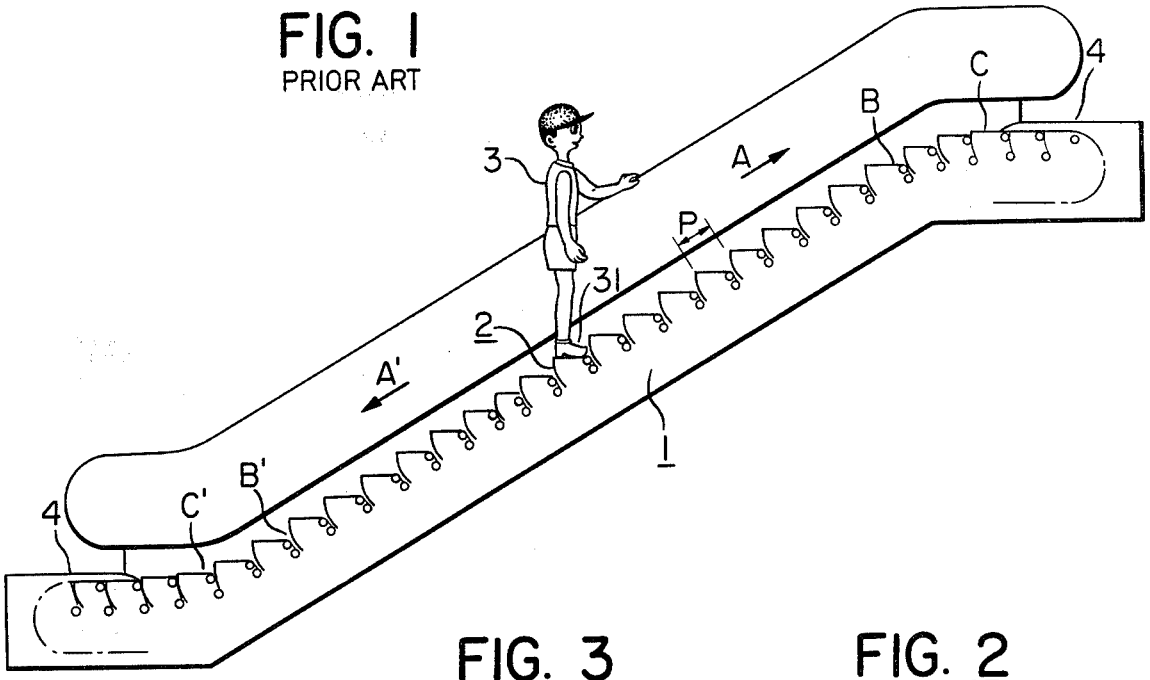
FIG. 1 PRIOR ART
FIG. 1 is a schematic vertical sectional view of an escalator.
Figure 3:
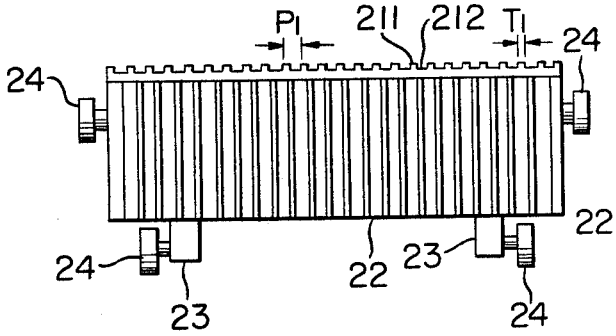
FIG. 3 PRIOR ART
FIG. 3 is a rear elevational view of the step shown in FIG. 2.
Figure 2:
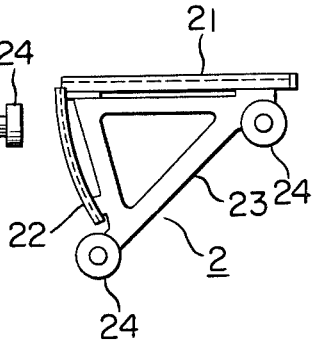
FIG. 2 PRIOR ART
FIG. 2 is an enlarged side elevational view of an example of a conventional escalator step.
Figure 4:
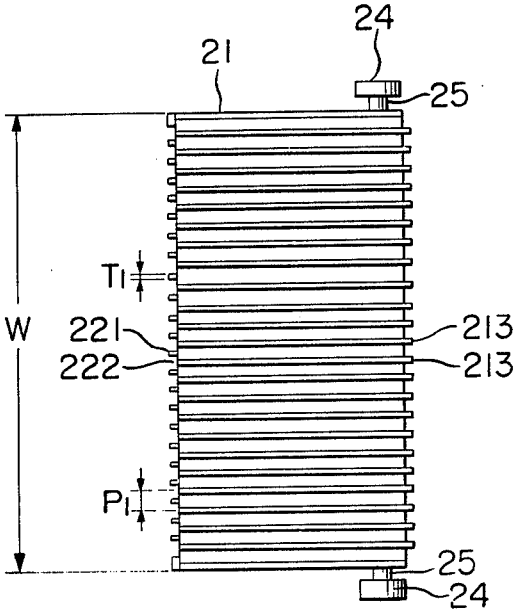
FIG. 4 PRIOR ART
FIG. 4 is a plan view of the step shown in FIG. 2.
Figure 5:
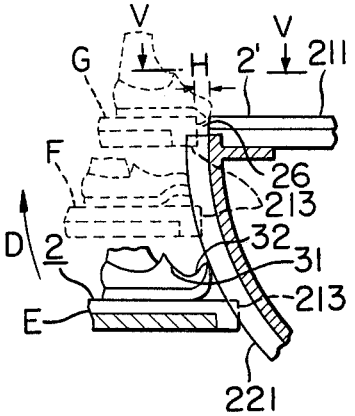
FIG. 5 PRIOR ART
FIG. 5 is a partial side elevational view, on an enlarged scale, showing the relationship between two adjoining steps when they move through the region between points B and C in FIG. 1.
Figure 6:
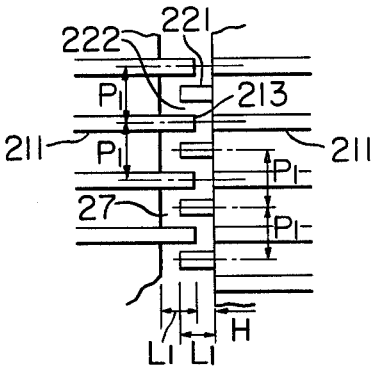
FIG. 6 PRIOR ART
FIG. 6 is a partial plan view of the steps shown in FIG. 5 as viewed in the direction shown by the arrows V in FIG. 5.
Figure 8:
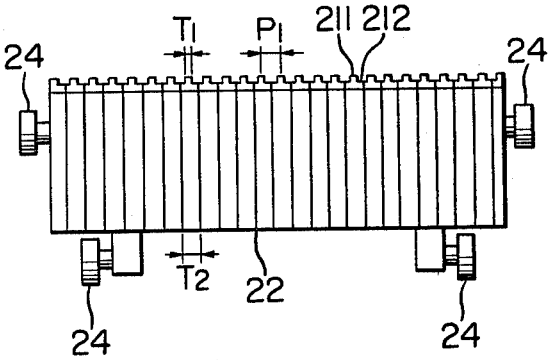
FIG. 8 PRIOR ART
FIG. 8 is a view similar to FIG. 3 of the step shown in FIG. 7.
Figure 7:
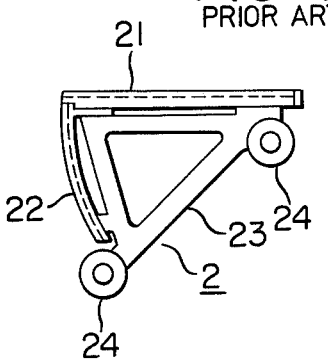
FIG. 7 PRIOR ART
FIG. 7 is an enlarged side elevational view of another example of a conventional elevator step.
Figure 9:
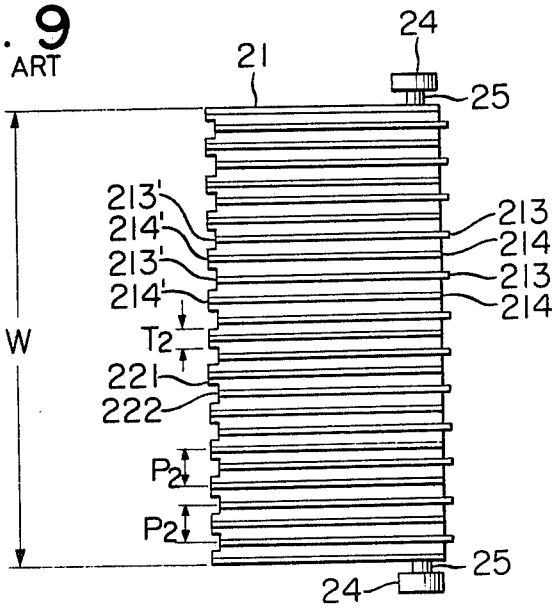
FIG. 9 PRIOR ART
FIG. 9 is a view similar to FIG. 4 of the step shown in FIG. 7.
Figure 10:
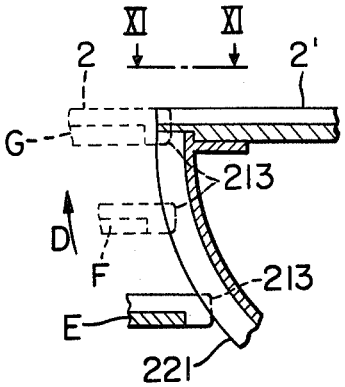
FIG. 10 PRIOR ART
FIG. 10 is a view similar to FIG. 5 showing the relationship between the two adjoining steps when they move through the region between points B and C in FIG. 1.
Figure 11:
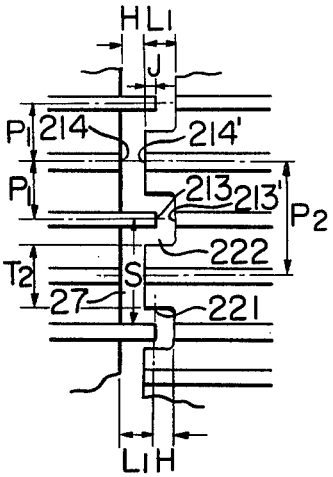
FIG. 11 PRIOR ART
FIG. 11 is a view similar to FIG. 6 of the steps shown in FIG. 10 and as viewed in the direction shown by the arrows XI in FIG. 10.
Figure 13:
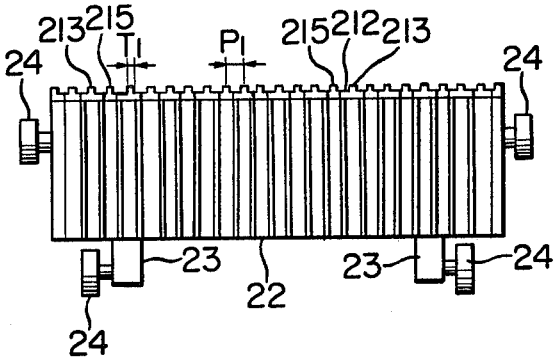
FIG. 13 is a rear elevational view of the step shown in FIG. 12.
Figure 12:
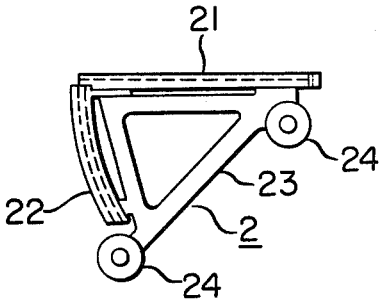
FIG. 12 is an enlarged side elevational view of an embodiment of the steps in accordance with the present invention.
Figure 14:
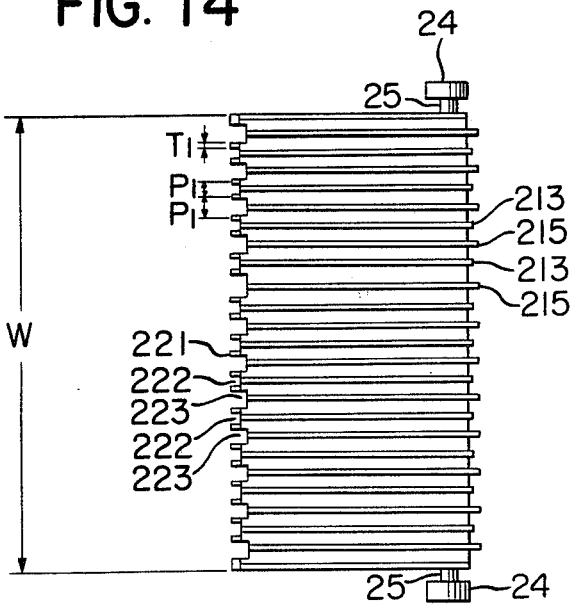
FIG. 14 is a plan view of the step shown in FIG. 12.

Therefore, when adjacent steps 2 and 2' are disposed in a stair-like configuration, i.e. steps 2 and 2' are located in the region between B and B' shown in FIG. 1, the gap 28 formed between projections 221 of riser 22 of step 2' and the forward end of tread 21 of step 2 and grooves 222 and 223 of the riser of preceeding step 2' always engage each other.

Therefore, when adjacent steps 2 and 2' are disposed in a stair-like configuration, i.e. steps 2 and 2' are located in the region between B and B' shown in FIG. 1, the gap 28 formed between projections 221 of riser 22 of step 2' and the forward end of tread 21 of step 2 located directly below step 2' is so small that it not only prevents footwear from being caught between it, but also makes it difficult for foreign objects such as dirt, etc. to fall through it, because pitch P1 of cleats 221 of riser 22 of step 2' is small and gap 28 has a zigzag configuration as it extends through first and second grooves 222 and 223 of riser 22 of step 2' between the surfaces of the grooves and the forward ends of second and first cleats 215 and 213 of tread 22 of step 2 located directly below step 2'. This condition is also maintained when steps 2 and 2' move from their stair-like configuration to a position where the treads are in a horizontal configuration, that is, from state F to state G shown in FIG. 15. Further, in the state where the treads of steps 2 and 2' are flush with each other in the horizontal direction, i.e. in the state shown at G in FIG. 15, since the forward ends of second cleats 215 of tread 21 of step 2 and the rear ends of first cleats 213 of tread 21 of preceeding step 2' are alternately intermeshed with each other and because dimension H is less than the difference between L2 and L1, the ends of cleats on one step actually overlap the projections on the riser on the next preceeding step by a dimension equal to J, so that the gap 28 between steps 2 and 2' has a zigzag configuration, and is not a straight line shaped gap. Therefore, there is no possibility of footwear 31 being caught in the gap formed between steps 2 and 2', or of foreign objects, such as coarse dirt, etc. falling through the gap. Thus over the whole range of the upper and lower landing portions only fine dust, which does not constitute any cause of trouble, falls through the gap formed between steps 2 and 2', thus improving the safety of passengers and the durability of the escalator.

Although the present invention has been described above in connection with the upwards movement of the escalator, the same effects are also achieved in the region between points B' and C' shown in FIG. 1 during the downward movement of the escalator.

Figure 17:
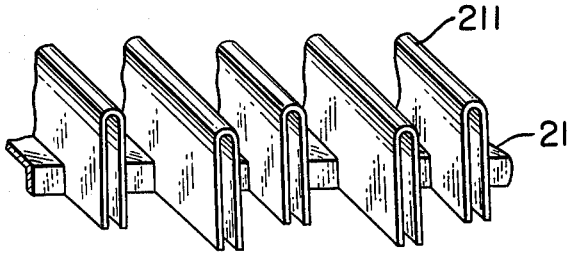
FIG. 17 is a partial perspective view, on an enlarged scale, of cleats of a tread of another embodiment of the steps in accordance with the present invention as viewed from the end opposite to the riser.
Figure 18:
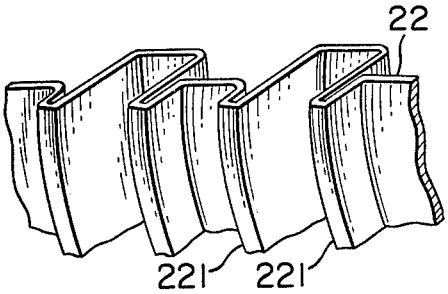
FIG. 18 is a partial perspective view of the cleats of the riser of the step having the cleats in FIG. 17.
Figure 19:
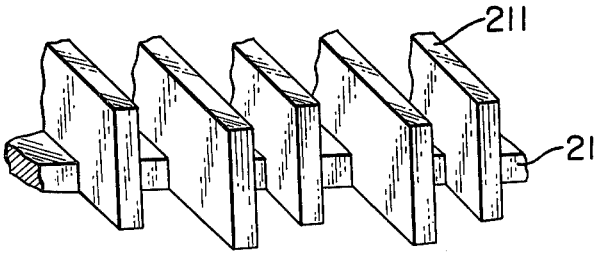
FIG. 19 is a similar view to FIG. 17 of cleats of a step of a further embodiment of the steps in accordance with the present invention.
Figure 20:
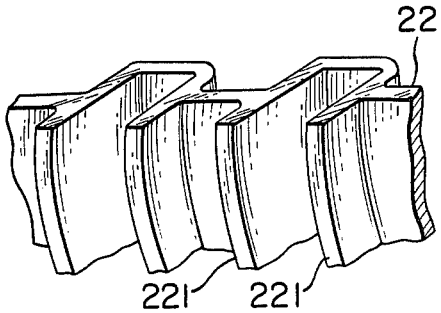
FIG. 20 is a similar view to FIG. 18 of the cleats shown in FIG. 19.

Further, in the above embodiment, tread 21 and riser 22 can be manufactured of metallic material in a conventional way, and riser 22 can be fabricated from sheet metal by a shaping process to produce a shape as shown in FIGS. 17 and 18. Alternatively, riser 22 can be fabricated by a cutting process or shaped by a moulding process to produce a shape as shown in FIGS. 19 and 20, respectively.

From the foregoing it will be appreciated that in accordance with the present invention, there is provided a step comprising a tread provided with a number of cleats and grooves alternately disposed thereon and a riser provided with a number of cleats and grooves alternately disposed on its convex surface, whereby the pitch between the neighbouring cleats of the riser is equal to that of the neighbouring cleats of the tread and the cleats of the riser are disposed so as to correspond to the grooves of the tread, there are two kinds of grooves in the riser, i.e. one being a shallow groove and the other being a deep groove, and the shallow grooves and the deep grooves are alternately disposed, and in the tread the cleats comprise first cleats and second cleats, the ends remote from the riser being alternately shorter and longer so that they engage the corresponding second and first grooves of the riser of the preceeding step, and at the same time the ends of the first and second cleats near the riser correspond to the bottoms of the second and first grooves in the riser. Therefore, when there is a grade between the adjoining steps, the projecting ends of the first and second cleats of the tread at the end opposite to the riser and the first and second grooves of the riser of the preceeding step engage each other in a zigzag fashion over the whole range of the length of the escalator from the lower to the upper landing portions. When the neighbouring steps have the treads in a horizontal state, the projecting ends of the first and second cleats of the tread of the step at the end opposite to the riser and the edge of the tread of the preceeding step at the riser side, i.e. the ends of the first and second cleats of the tread of the preceeding step at the side of the riser, engage each other in a zigzag fashion, with the result that nothing will be caught between the adjacent steps or fall therethrough, resulting in higher safety.

While certain preferred embodiments of the present invention have been described and illustrated herein it will be understood that various modifications may be made without departing from the spirit of the present invention.

What is claimed is:

1. An escalator step comprising a tread having a plurality of cleats therein defining grooves therebetween alternating with the cleats; and a riser at one edge of said tread and having a convex surface with a plurality of projections thereon defining grooves therebetween alternating with said projections, the pitch between adjacent projections on said convex riser surface being the same as that between adjacent cleats on said tread and said projections on said convex riser surface being positioned so as to correspond to said grooves in said tread, alternate grooves in said riser being first shallow grooves and the remainder being second deep grooves, the end of said tread adjacent said riser having a profile corresponding to the first and second grooves and projections of said riser, alternate cleats on said tread being first cleats having the ends at the side opposite said riser projecting a short distance corresponding to the depth of said first grooves of said riser and being positioned to correspond to the positions of said first grooves in said riser, and the remaining cleats on said tread being second cleats having the ends at the side opposite said riser projecting a long distance corresponding to the depth of said second grooves of said riser and being positioned to correspond to the positions of said second grooves in said riser, whereby, when neighbouring said steps are disposed in a stair-like relationship or with said treads horizontal and level with each other, the projecting ends of the first and second cleats of the tread of one of said steps at the side opposite the riser always project into the grooves in the riser of the preceeding step.

2. An escalator step as claimed in claim 1 wherein said cleats and grooves are pressed from a thin metal sheet.

3. An escalator step as claimed in claim 1 wherein said cleats on said tread which project a longer distance project a distance L2, and said cleats on said tread which project a short distance L1, and the ends of said projecting portions of said treads are spaced a distance H from the bottoms of the grooves in the next preceding step when said steps are assembled into a stair, and said distance H is less than the difference between said distances L2 and L1, whereby the cleats which project a short distance overlap the projections on the riser of the next preceding step.

* * * * *